US008863331B2

(12) United States Patent
Valentino et al.

(10) Patent No.: US 8,863,331 B2
(45) Date of Patent: Oct. 21, 2014

(54) SECURING MECHANISM FOR A HEIGHT ADJUSTABLE EMERGENCY COT

(75) Inventors: Nicholas Vittorio Valentino, Dayton, OH (US); Bryan Robert Keller, Springboro, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 179 days.

(21) Appl. No.: 13/264,402

(22) PCT Filed: Apr. 19, 2010

(86) PCT No.: PCT/US2010/031590

§ 371 (c)(1),
(2), (4) Date: Dec. 20, 2011

(87) PCT Pub. No.: WO2010/121244

PCT Pub. Date: Oct. 21, 2010

(65) Prior Publication Data

US 2012/0098289 A1 Apr. 26, 2012

Related U.S. Application Data

(60) Provisional application No. 61/170,254, filed on Apr. 17, 2009.

(51) Int. Cl.

| | |
|---|---|
| ***A47C 7/00*** | (2006.01) |
| ***A61G 1/02*** | (2006.01) |
| ***A61G 1/04*** | (2006.01) |
| ***A61G 1/013*** | (2006.01) |

(52) U.S. Cl.

CPC ..... *A61G 1/013* (2013.01); *A61G 1/0262* (2013.01); *A61G 1/04* (2013.01); *A61G 1/0212* (2013.01)

USPC ..... 5/611; 5/620; 5/627; 5/86.1; 5/110; 5/114

(58) Field of Classification Search

CPC ..... A61G 1/04; A61G 1/0212; A61G 1/013; A61G 1/0567; A61G 1/0562; A61G 5/006

USPC ..... 5/620, 625–629, 110–112, 114; 296/20; 74/143–144, 575, 577 M

See application file for complete search history.

(56) References Cited

U.S. PATENT DOCUMENTS 4,691,393 A 9/1987 Kuck
5,435,027 A * 7/1995 Bourgraf et al. ..... 5/611

(Continued)

FOREIGN PATENT DOCUMENTS

GB 2 427 597 A 1/2007

OTHER PUBLICATIONS

Search Report for PCT/US2010/031590 dated Jul. 2, 2010.

*Primary Examiner* — William Kelleher
*Assistant Examiner* — Duoni Pan
(74) *Attorney, Agent, or Firm* — Dinsmore & Shohl LLP

(57) ABSTRACT

Embodiments of a height adjustable emergency roll-in cot comprise a cot support frame comprising having a leading end, a trailing end, and a pair of opposing side frame members disposed between the leading and trailing ends, a pair of wheeled front legs slidingly coupled to the cot support frame via a slideable front transverse support member, and a pair of wheeled back legs slidingly coupled to the support frame via a slideable back transverse support member, wherein the slideable front transverse support member, the slideable back transverse support member, or both include a pair of locking pins (90, 92). The height adjustable emergency roll-in cot comprises a long ratchet bar (130) and a short ratchet bar (140) connected and parallel to one another, wherein the short ratchet bar and the long ratchet bar define different slot profiles (132, 142) such that when the slots of the long ratchet bar and the slots of the short ratchet bar are configured to engage the respective locking pins, the long ratchet bar engages its respective locking pin before the short ratchet car.

4 Claims, 9 Drawing Sheets

(56) References Cited

U.S. PATENT DOCUMENTS

| | | | | |
|---|---|---|---|---|
| 5,537,700 | A * | 7/1996 | Way et al. | 5/611 |
| 5,887,302 | A | 3/1999 | DiMucci et al. | |
| 6,701,545 | B1 | 3/2004 | Ferneau et al. | |
| 7,302,718 | B2 * | 12/2007 | Ferneau et al. | 5/86.1 |
| 7,676,861 | B2 * | 3/2010 | Ward et al. | 5/428 |
| 7,856,685 | B2 * | 12/2010 | Matunaga et al. | 5/611 |
| 8,156,586 | B2 * | 4/2012 | Reed et al. | 5/611 |
| 2007/0152092 | A1 * | 7/2007 | Ponka | 242/383.4 |

* cited by examiner

SECURING MECHANISM FOR A HEIGHT ADJUSTABLE EMERGENCY COT

The present invention relates generally to securing mechanisms and in particular, to securing mechanism for a height adjustable emergency cot.

Height adjustable emergency cots which use a ratchet bar mechanism as part of a securing mechanism are known, for example, by U.S. Pat. Nos. 5,435,027, 5,537,700, and 5,887,302, each of which are incorporated by reference herein in their entirety. Such ratchet bar mechanisms are used to retain the emergency cot in a number of positions from a lower bed position to a fully evaluated position by a pair of position pins engaging associated teeth of the bars. An example of a common prior ratchet bar mechanism is depicted by FIG. 9, wherein a typical prior art tooth profile used for the teeth of each ratchet bar is depicted by FIG. 10. In such a prior art design, due to the two ratchet bars having the same tooth profile which engage position pins at the same time, a situation can occur where the two teeth can cause an issue, either saddling or wedging between the position pins and the teeth of each ratchet bar. The saddling and wedging issues are shown in FIG. 11.

Additionally, in some of the above mentioned height adjustable emergency cots which use ratchet bars as part of a securing mechanism, an operator and an assistant must first lift the cot at each end to take the weight off the ratchet bar mechanism. In some prior art cot design, both ends of the cot must be lifted simultaneously. Lifting typically involves the operator and the assistant gripping a tubing portion at each end of the cot. Once the load is removed from the ratchet bar mechanism by lifting the cot, the operators must then release their grip from around the tubing while still assuming the weight of the cot and possibly a patient thereon, and grab and pull a respective release handle in order to release each ratchet bar from a pin engagement, thereby allowing the cot to change heights.

As a background, a prior art cot is depicted in FIG. 12. As shown, the cot frame has a leading end and a trailing end, with the leading end again defined as the end toward the load wheels 50. Cot frame includes a pair of opposing tubular side frame members 36, 38 which are interconnected at their respective ends by tubular transverse frame members 40, 42, respectively. The leading end of cot frame includes a pair of supports 44, 46 which extend downwardly from each of opposing side frame members 36, 38. The opposite ends of supports 44, 46 are secured to a transverse member 48 which extends across and below the cot frame. A pair of load wheels 50 are secured to cot frame through transverse member 48 by rotatable fittings 49*a* and 49*b*.

As shown in FIG. 12, the uppermost ends of first frame members 26, 28 are rotatably connected to transverse frame member 48 on cot frame adjacent the leading end thereof. The uppermost ends of the second frame members 30, 32 are rotatably connected to a transverse support member 58. Transverse support member 58 is slidably mounted in a pair of opposing brackets 60, 62 secured to cot frame.

The roll-in cot includes means for latching the pairs of frame members 26, 28, 30, and 32 in said at least two, and preferably several positions ranging from a first down, fully collapsed position to a fully elevated position. The latching means are generally indicated at 80 and comprise a pair of ratchet bars 82, 84 secured together by cross piece 100. Each of the ratchet bars are secured at respective first ends thereof to transverse member 48 on cot frame and at respective second ends thereof to cross piece 100. Each of the ratchet bars 82, 84 includes a plurality of spaced apart slots, generally indicated at 86, 88. The slots are angled and adapted to engage a corresponding pair of load-bearing pins 90, 92 located on transverse support member 58.

As shown, pin engaging means, such as handles 94 and 96, are operatively connected to the ratchet bars by a cross piece 100. These handles may be manipulated by the emergency medical technician standing at the end of the cot by pulling them to disengage pins 90, 92 from individual slots. Spring 98 biases ratchet bars 82, 84 to force slots 86, 88 to engage with pins 90, 92. As slots 86, 88 are angled to seat with pins 90, 92, and transverse support member 58 is load bearing, the latching mechanism provides a positive lock of cot into a desired position.

Embodiments of the present invention are directed to a new securing mechanism for a height adjustable emergency cot which addresses the above mentioned problems. In one embodiment, a securing mechanism having a ratchet bar design comprising two different tooth profiles (long and short) is disclosed. In another embodiment, a securing mechanism having a handle assembly having a spring cylinder used to actuate the ratchet bars to raise or lower a cot is disclosed.

According to one embodiment, a height adjustable emergency roll-in cot comprises a cot support frame comprising having a leading end, a trailing end, and a pair of opposing side frame members disposed between the leading and trailing ends, a pair of wheeled front legs slidingly coupled to the cot support frame via a slideable front transverse support member, and a pair of wheeled back legs slidingly coupled to the support frame via a slideable back transverse support member, wherein the slideable front transverse support member, the slideable back transverse support member, or both include a pair of locking pins. The cot also comprises a long ratchet bar and a short ratchet bar connected and parallel to one another, wherein the short ratchet bar and the long ratchet bar define different slot profiles such that when the slots of the long ratchet bar and the slots of the short ratchet bar are configured to engage the respective locking pins, the long ratchet bar engages its respective locking pin before the short ratchet car.

According to a further embodiment, the height adjustable emergency roll-in cot comprises a handle coupled to the trailing end of the support frame, and a mechanical spring cylinder connecting the handle to the long ratchet bar, wherein the actuation of the handle extends the mechanical spring cylinder, and disengages the locking pins from the long and short ratchet bars.

These, and other features and advantages of the present invention, will become apparent from the following description and the accompanying drawings.

Embodiments of the securing mechanism of the present invention provide several advantages over prior art securing mechanism comprising ratchet bar mechanisms.

Figure 1:
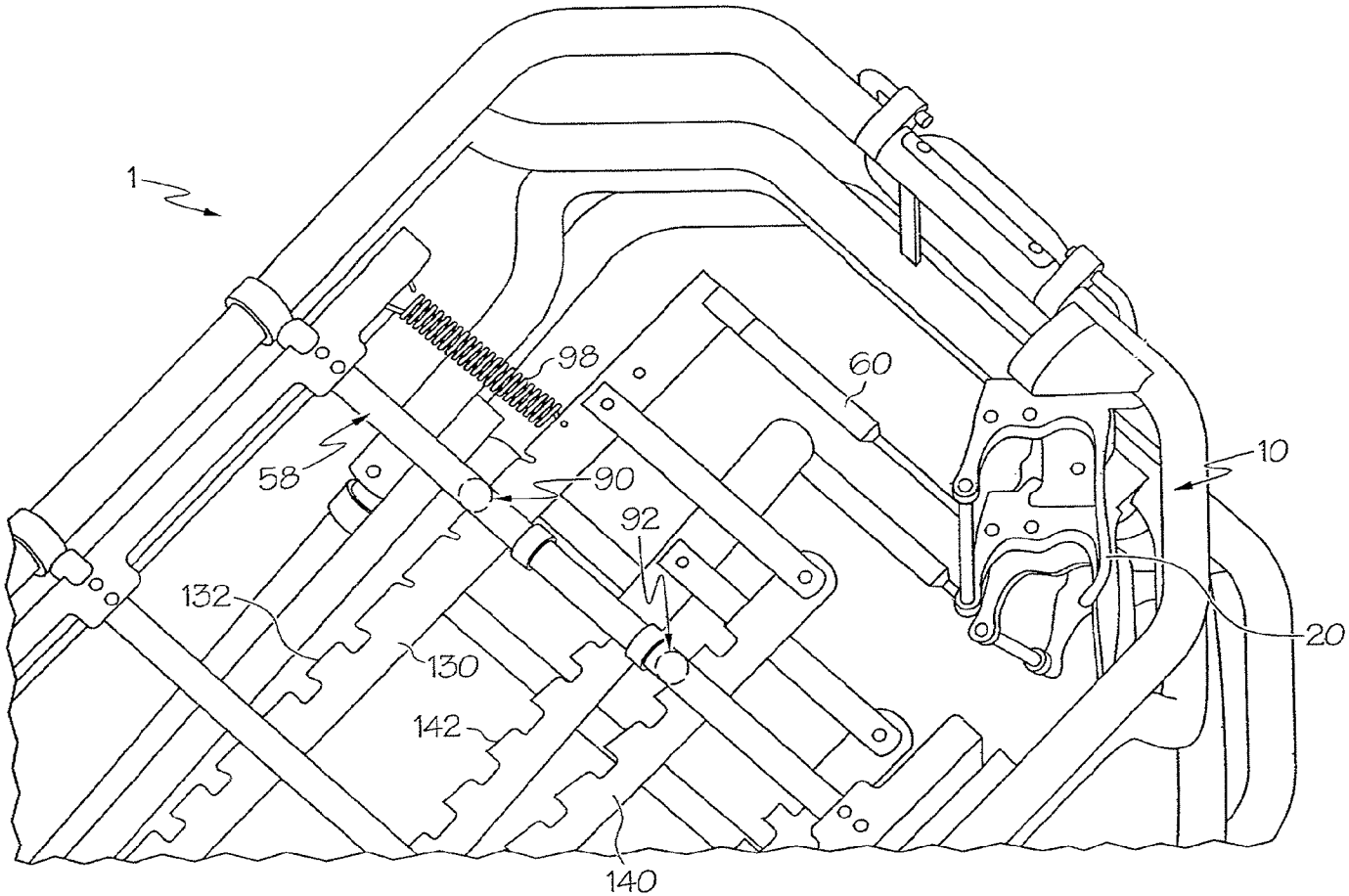
FIG. 1 is a top perspective view of a securing mechanism having ratchet bar design comprising two different tooth profiles (long and short) and a handle assembly used to actuate the ratchet bars to raise or lower a cot according to an embodiment of the present invention.
Figure 2B:
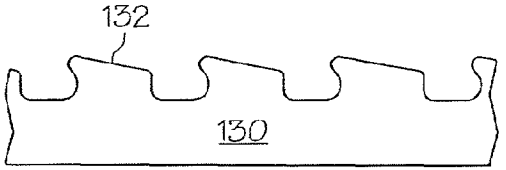
FIG. 2B is a close up section view taken of FIG. 2A.
Figure 2A:
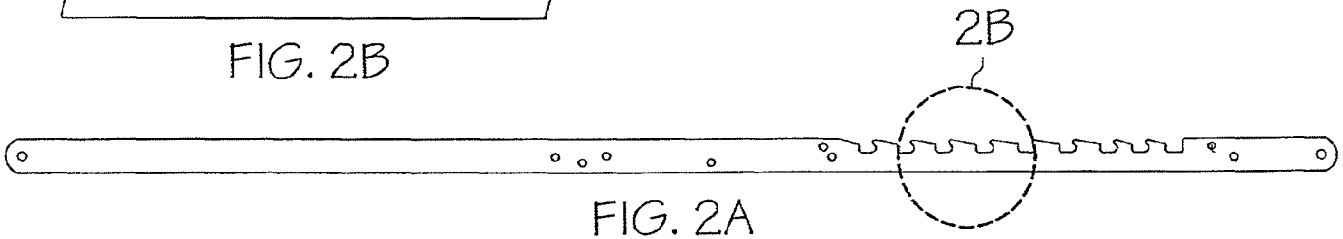
FIG. 2A is a side view of a long ratchet bar according to an embodiment of the present invention.
Figure 3B:
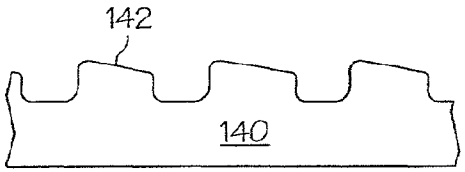
FIG. 3B is a close up section view taken of FIG. 3A.
Figure 3A:
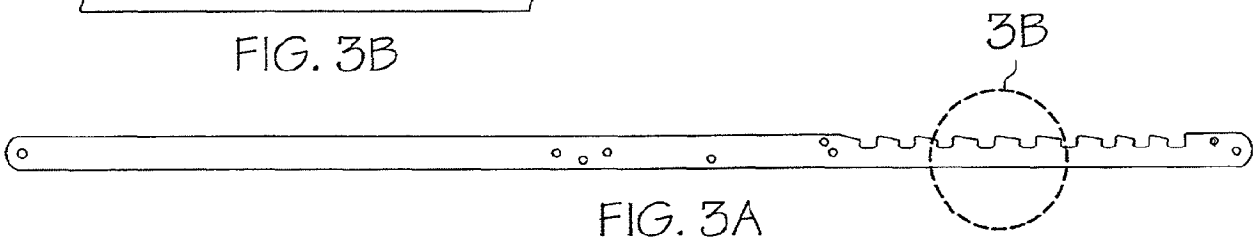
FIG. 3A is a side view of a short ratchet bar according to an embodiment of the present invention
Figure 11B:
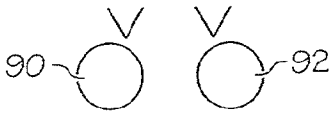
FIG. 11B (PRIOR ART)
FIGS. 11A and 11B depicts saddling (FIG. 11A) and wedging (FIG. 11B) issues which may occur with the ratchet bar arrangement of FIG. 9 with the teeth thereof having a tooth profile according to FIG. 10.
Figure 11A:
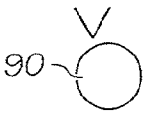
FIG. 11A (PRIOR ART)
Figure 12:
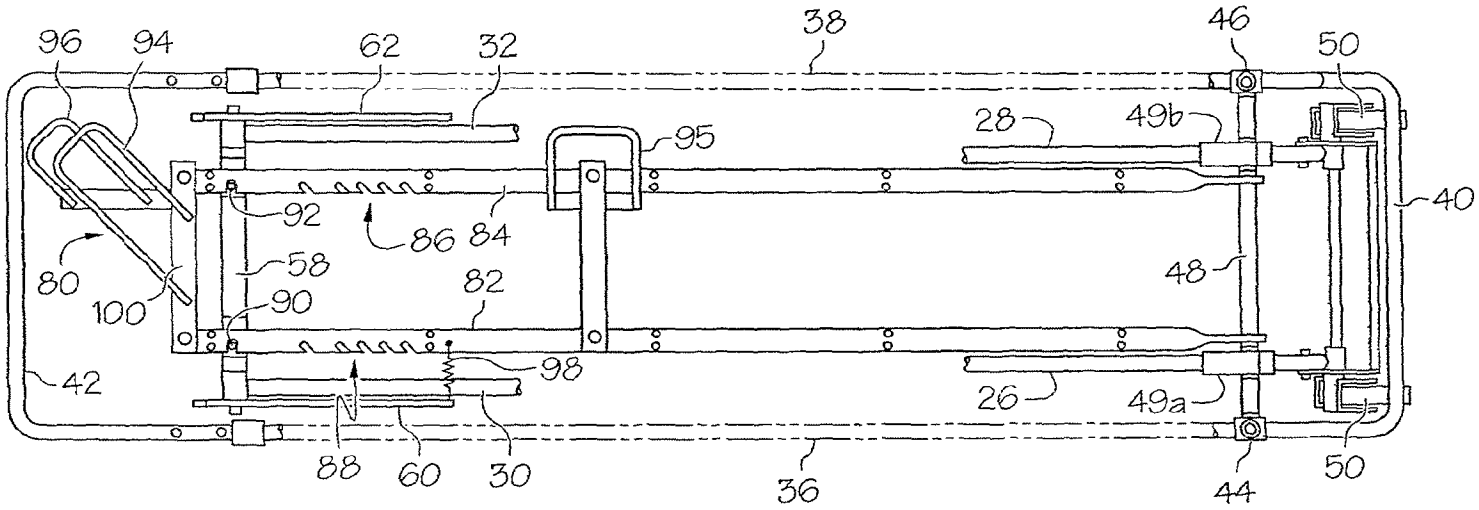
FIG. 12 (PRIOR ART)
FIG. 12 depicts an example of a common prior cot with a common ratchet bar arrangement.

Referring to FIG. 1, in one embodiment, a securing mechanism comprising a ratchet bar mechanism having two different tooth profiles (long 130 and short 140) is disclosed. As shown in FIGS. 2A-3B, the securing mechanism includes long and short ratchet teeth profiles 132 and 142, respectively. The long ratchet teeth profile 132 shown in FIG. 2A-B is made to engage a respective position pin by itself so that both sets of teeth (i.e., long and short) are not engaging the two position pins at the same time in which to cause either a saddling or wedging issue. As shown by FIGS. 3A-B, the short ratchet teeth profile 142 is made to not engage the pin until the long ratchet teeth have selected a direction of engagement. Accordingly, the issues, such as depicted by FIGS. 11A and 11B, have been eliminated by taking one tooth out of the equation of selecting which side of the position pins the ratchet bars will travel to either engage or disengage from the pins.

Figure 4A:
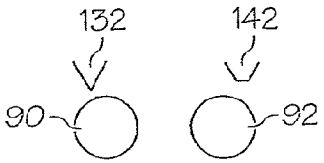
FIGS. 4A and 4B depict the advantages of the securing mechanism of FIG. 1 in avoiding any issues, either saddling (FIG. 4A) or wedging (FIG. 4B), between position pins and the teeth of the long and short ratchet bars.
Figure 4B:
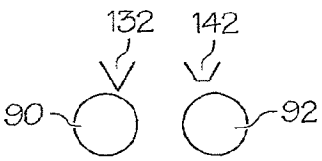

Referring to FIG. 1, in other words, the long ratchet teeth 132 will select which direction to engage the respective position pin 90, wherein the short ratchet teeth 142 will not engage its respective position pin 92 until the long ratchet teeth 132 has selected the direction of engagement. Thus, the long ratchet bar 130 always decides for the short ratchet bar 140 whether or not they will engage or disengage the pins 90, 92, and in what direction without issue. FIGS. 4A-4B depicts the advantages of the securing mechanism of FIG. 1 in avoiding any issues, either saddling or wedging, between position pins 90, 92 and the teeth 132, 142 of the long and short ratchet bars 130, 140, respectively.

Referring to FIGS. 1, 5-8, in another embodiment, the securing mechanism further comprises a handle assembly 20 having a handle and a spring cylinder 60 used to actuate the ratchet bars 130, 140 to raise or lower a cot 1 is disclosed. In one embodiment, the spring cylinder 60 is a single-acting piston-type cylinder which uses fluid pressure to provide a force in one direction, and spring tension, compressed air, or nitrogen is used to provide the force in the opposite direction. The handle 20 is designed to actuate the ratchet bars 130, 140 such that a cot may be lowered or raised. The spring cylinder 20 acts rigid except when the cot is in a locked position.

Figure 5:
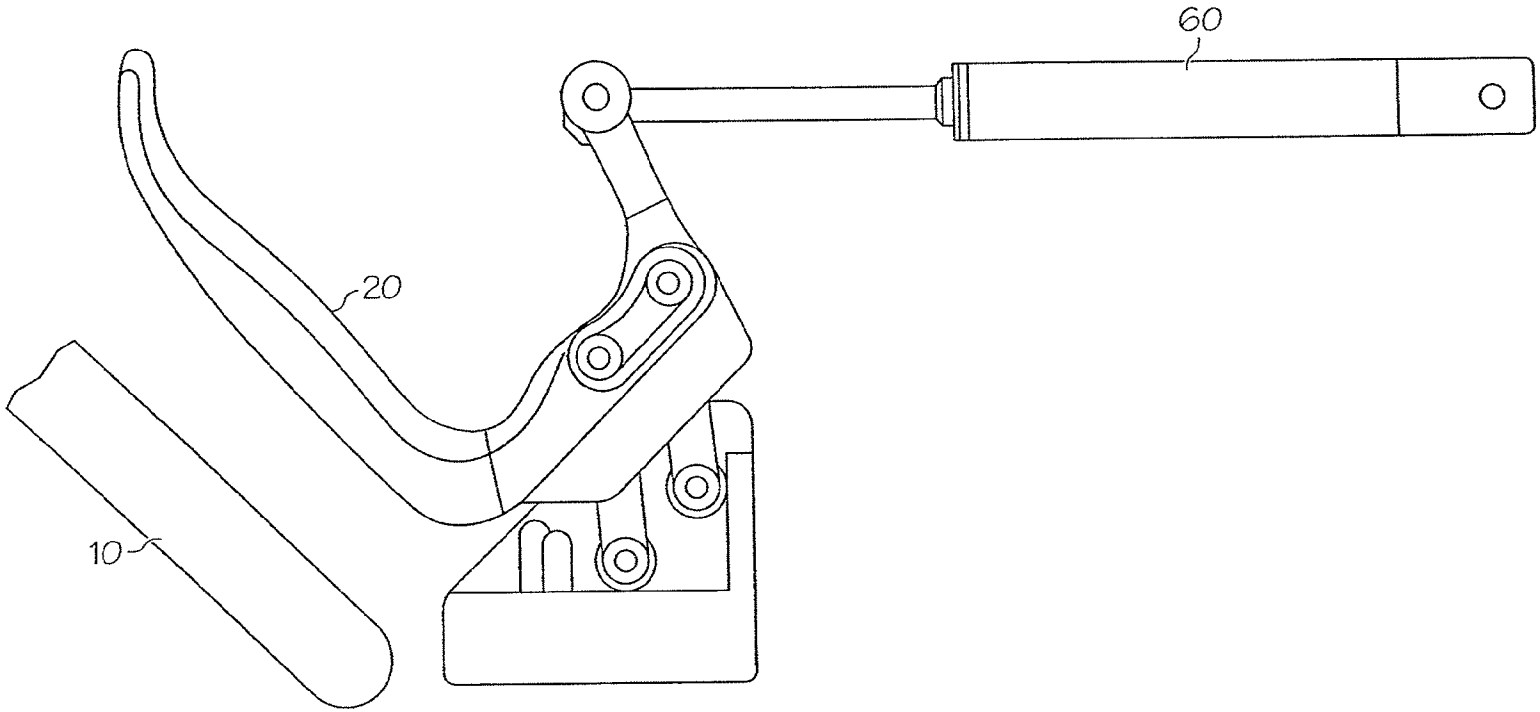
FIG. 5 is a close-up top view of a handle assembly of the securing mechanism of FIG. 1 with a handle mount thereof shown in section and with a handle thereof in a rest position (i.e., un-pulled).
Figure 6:
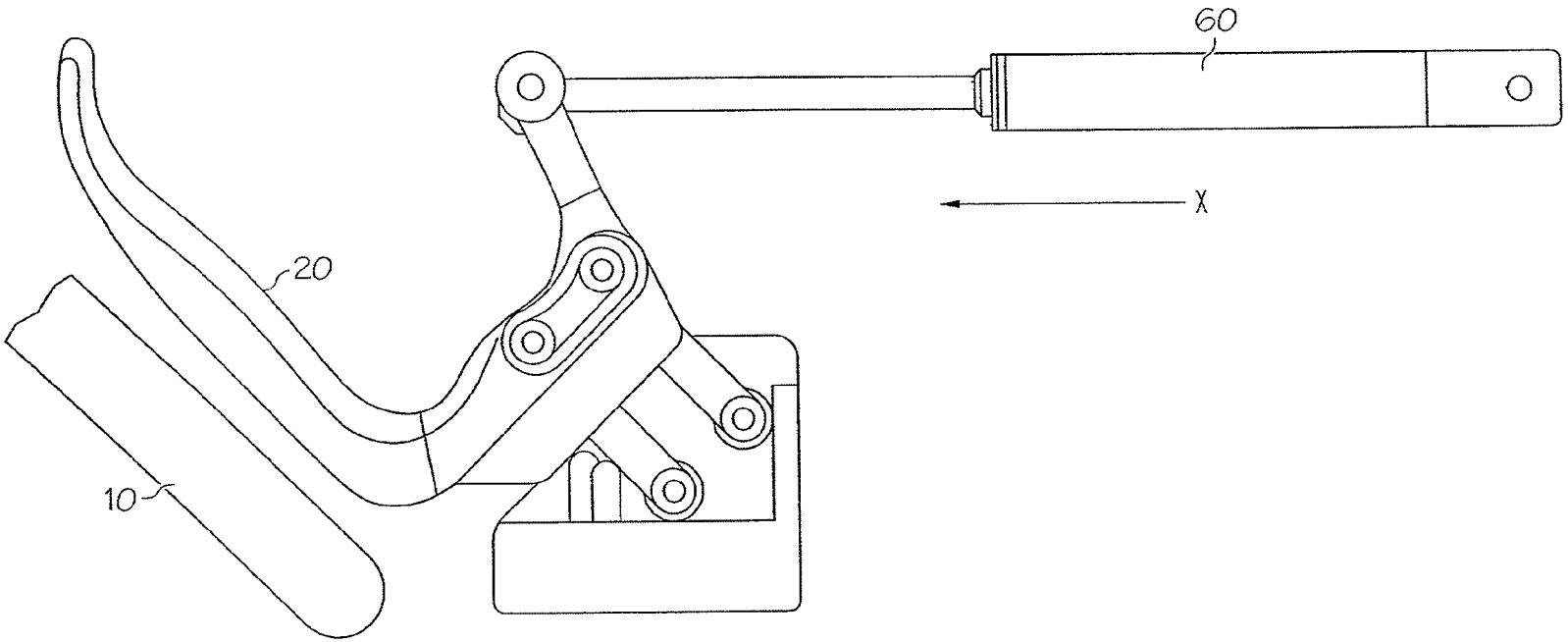
FIG. 6 is a top view of the handle assembly of FIG. 5 with the handle in a fully pulled position.
Figure 7:
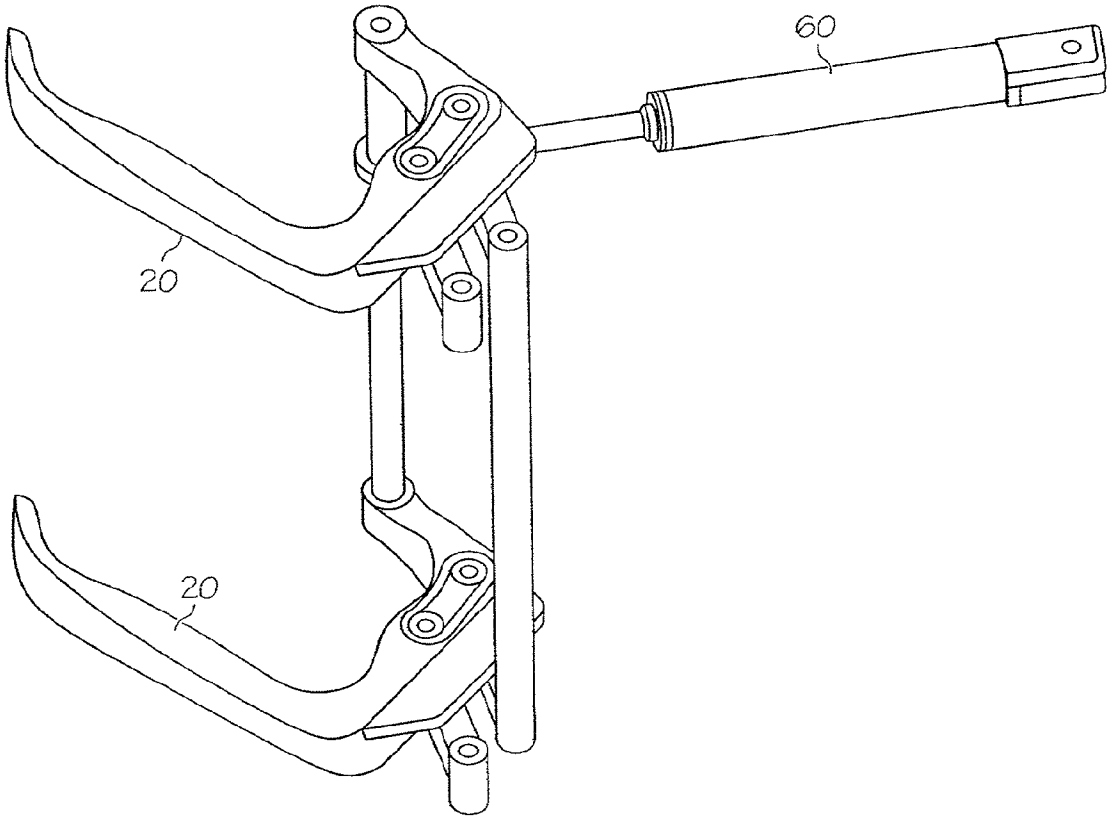
FIG. 7 is a close-up perspective top view of a handle assembly of the securing mechanism of FIG. 1 with the handle thereof in a rest position (i.e., un-pulled).
Figure 8:
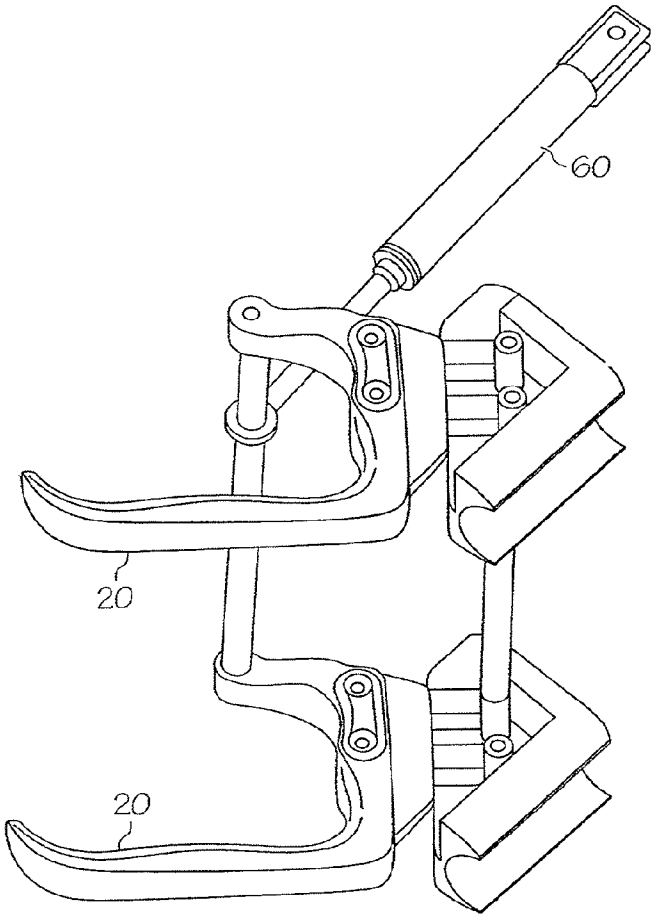
FIG. 8 is a close-up perspective top view of a handle assembly of the securing mechanism of FIG. 1 with the handle thereof in a fully pulled position.
Figure 9:
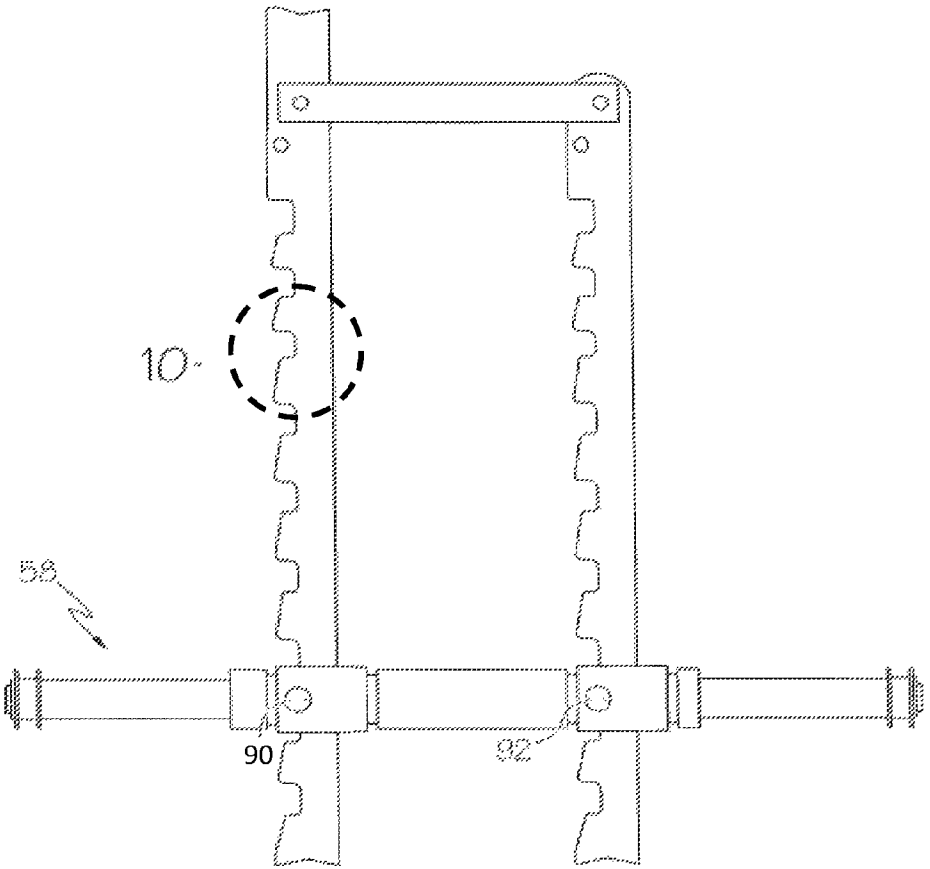
FIG. 9 (PRIOR ART)
FIG. 9 depicts an example of a common prior ratchet bar arrangement.
Figure 10:
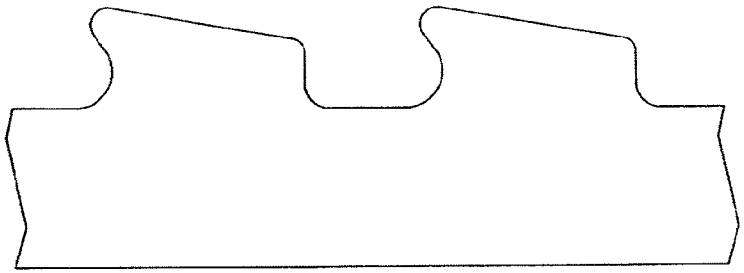
FIG. 10 (PRIOR ART)
FIG. 10 depicts a typical prior art tooth profile used for the teeth of each ratchet bar depicted by FIG. 9.

When in a locked position, in one embodiment the spring cylinder 60 will release at about twenty (20) pounds of force and allow an operator to preload the system by squeezing the handle 20. As such the handle 20 is permitted to transition closer to a frame member 10 of the cot as depicted in FIGS. 5 and 6 without causing movement (i.e., release) of ratchet bars. Referring to FIG. 1, spring tension e.g., via a ratchet bar return spring 98, is also provided to ensure a preloading release without movement of the ratchet bars 130, 140. Such preloading by squeezing the handle 20, then allows the operator to assume the weight of the cot without having to also release the grip on the cot, such as from tubing used for lifting, to pull the handle 2-0 in order to unlock the cot when raising or lowering the cot. In other words, once the handle 20 has been squeezed and the system is preloaded by the spring cylinder extending, the operator can assume the weight of the cot and the ratchet bars 130, 140 will automatically release from the pins 90, 92 by the force of the spring cylinder 60 retracting in the direction indicated by X in FIG. 6, thereby permitting the cot to be raised or lowered. This especially important when carrying a patient thereon because the operator does not have to release their grip on the cot.

It is to be appreciated that the handle assembly 20 allows the operator to get a better ergonomic grip prior to having to assume the weight of the cot. With the new mechanism, the operator can grab the tubing and the handle with the initial grip (preloading the system), at the same time prior to lifting the cot. Once the weight is assumed, the spring 60 connected to the handle overcomes the ratchet bar return spring force 98 causing the ratchet bar 130 to release. The operator does not need to change their grip until they have the cot 1 in the desired position, then the operator releases their grip and the ratchet goes back into the locked position.

Having described the invention in detail and by reference to preferred embodiments thereof, it will be apparent that modifications and variations are possible without departing from the scope of the invention.

The invention claimed is:

1. A height adjustable emergency roll-in cot comprising:

a cot support frame comprising having a leading end, a trailing end, and a pair of opposing side frame members disposed between the leading and trailing ends;

a pair of wheeled front legs slidingly coupled to the cot support frame via a slideable front transverse support member, and a pair of wheeled back legs slidingly coupled to the support frame via a slideable back transverse support member, wherein the slideable front transverse support member, the slideable back transverse support member, or both include a pair of locking pins, and a long ratchet bar and a short ratchet bar connected and parallel to one another, wherein the short ratchet bar and the long ratchet bar define different shaped slot profiles from each other such that when the slots of the long ratchet bar and the slots of the short ratchet bar are configured to engage the respective locking pins, the long ratchet bar engages its respective locking pin before the short ratchet bar.

2. A height adjustable emergency roll-in cot comprising:

a cot support frame comprising having a leading end, a trailing end, and a pair of opposing side frame members disposed between the leading and trailing ends;

a pair of wheeled front legs slidingly coupled to the cot support frame via a slideable front transverse support member, and a pair of wheeled back legs slidingly coupled to the support frame via a slideable back transverse support member, wherein the slideable front transverse support member, the slideable back transverse support member, or both include a pair of locking pins;

a long ratchet bar and a short ratchet bar connected and parallel to one another, wherein the short ratchet bar and the long ratchet bar define different shaped slot profiles from each other such that when the slots of the long ratchet bar and the slots of the short ratchet bar are configured to engage the respective locking pins of the back transverse support member, the long ratchet bar engages its respective locking pin before the short ratchet bar;

a handle coupled to the trailing end of the support frame; and a mechanical spring cylinder connecting the handle to the long ratchet bar, wherein the actuation of the handle extends the mechanical spring cylinder, and disengages the locking pins from the long and short ratchet bars.

3. The height adjustable emergency roll-in cot of claim 2 comprising a ratchet bar return spring coupling the long ratchet bar to the one of the side frame members.

4. The height adjustable emergency roll-in cot of claim 2 wherein the long ratchet bar and the short ratchet bar are connected by a cross piece.

* * * * *